US012082711B2

(12) United States Patent
Kim

(10) Patent No.: US 12,082,711 B2
(45) Date of Patent: Sep. 10, 2024

(54) PARASOL PROVIDED WITH CHAIR

(71) Applicant: YOUFUNI CO., LTD., Pocheon-si (KR)

(72) Inventor: Jeong Ki Kim, Seoul (KR)

(73) Assignee: YOUFUNI CO., LTD. (KR)

( * ) Notice: Subject to any disclaimer, the term of this patent is extended or adjusted under 35 U.S.C. 154(b) by 140 days.

(21) Appl. No.: 17/777,610

(22) PCT Filed: Jun. 30, 2020

(86) PCT No.: PCT/KR2020/008542
§ 371 (c)(1),
(2) Date: May 17, 2022

(87) PCT Pub. No.: WO2021/101004
PCT Pub. Date: May 27, 2021

(65) Prior Publication Data

US 2022/0408930 A1 Dec. 29, 2022

(30) Foreign Application Priority Data

Nov. 22, 2019 (KR) ..... 10-2019-0151510

(51) Int. Cl.
*A47C 7/66* (2006.01)
*A45B 5/00* (2006.01)
(Continued)

(52) U.S. Cl.
CPC ..... *A47C 7/664* (2018.08); *A45B 5/00* (2013.01); *A45B 23/00* (2013.01); *A47B 37/04* (2013.01);
(Continued)

(58) Field of Classification Search
CPC ..... A47C 16/00; A47C 7/004; A47C 7/664; A45B 5/00; A47B 2003/004; A47B 37/04
(Continued)

(56) References Cited

U.S. PATENT DOCUMENTS 2,039,805 A * 5/1936 Knight ..... A47B 37/04 108/148
2,785,735 A * 3/1957 Banks ..... A47C 9/105 248/435
(Continued)

FOREIGN PATENT DOCUMENTS

CN 204192051 U 3/2015
CN 205831283 U * 12/2016 ..... A45B 23/00
(Continued)

OTHER PUBLICATIONS

International Search Report for PCT/KR2020/008542, mailed Oct. 23, 2020.

*Primary Examiner* — Timothy J Brindley
(74) *Attorney, Agent, or Firm* — Renaissance IP Law Group LLP

(57) ABSTRACT

Disclosed is a parasol with a chair which allow users such as the elderly sit and rest on a chair by installing the chair on a prop of a parasol installed in a crosswalk, a park, etc., is made lighter and has construction convenience by extruding the chair into a fiber-bonded form, has a high tensile strength to make discoloration inhibition caused by ultraviolet rays excellent while being easily damaged, has non-toxic flame retardant properties to implement high resistance to fire, and has excellent tensile strength, improved strength, and excellent water pressure resistance by using glass fiber, thereby achieve long lifespan.

4 Claims, 6 Drawing Sheets

(51) Int. Cl.

| | |
|---|---|
| ***A45B 23/00*** | (2006.01) |
| ***A47B 37/00*** | (2006.01) |
| ***A47B 37/04*** | (2006.01) |
| ***A47C 7/00*** | (2006.01) |
| ***A47C 16/00*** | (2006.01) |

(52) U.S. Cl.
CPC ..... *A47C 7/004* (2013.01); *A47C 16/00* (2013.01); *A45B 2200/1009* (2013.01)

(58) Field of Classification Search
USPC ..... 297/423.39
See application file for complete search history.

(56) References Cited

U.S. PATENT DOCUMENTS

| | | | | |
|---|---|---|---|---|
| 2,799,543 | A * | 7/1957 | Tomaselli | A45B 23/00 D3/10 |
| 3,397,881 | A * | 8/1968 | Hedgecock | C09B 23/04 126/25 R |
| 3,434,484 | A * | 3/1969 | Dilullo | A45B 17/00 108/6 |
| 5,188,424 | A * | 2/1993 | Herron | A47C 9/10 297/195.1 |
| 6,837,386 | B1 | 1/2005 | Kent et al. | |
| 9,144,315 | B1 * | 9/2015 | Cheng | A47C 7/506 |
| 9,445,664 | B1 * | 9/2016 | Gapp | A47B 13/003 |
| 11,045,002 | B1 * | 6/2021 | Saperton | A47C 7/004 |
| 11,612,247 | B1 * | 3/2023 | Rusch | A47C 3/24 297/423.12 |
| 2002/0162490 | A1 * | 11/2002 | Petryna | A47B 37/04 108/151 |
| 2003/0151291 | A1 * | 8/2003 | Lin | A47C 7/004 297/423.38 |
| 2011/0226925 | A1 * | 9/2011 | Tsai | A47C 7/5064 248/411 |
| 2014/0041556 | A1 * | 2/2014 | Diepenbrock | A47B 13/00 108/50.13 |
| 2019/0335893 | A1 * | 11/2019 | Erickson | A47B 37/04 |
| 2020/0085186 | A1 * | 3/2020 | Winchester | B65D 1/34 |

FOREIGN PATENT DOCUMENTS

| | | | | |
|---|---|---|---|---|
| CN | 110664149 | A * | 1/2020 | |
| CN | 113273780 | A * | 8/2021 | A45B 5/00 |
| EP | 0432576 | A2 * | 6/1991 | |
| KR | 950000256 | U | 1/1995 | |
| KR | 20040102389 | A | 12/2004 | |
| KR | 20050039173 | A | 4/2005 | |
| KR | 20150003516 | U | 9/2015 | |
| KR | 101796394 | B1 | 11/2017 | |
| KR | 101930783 | B1 | 12/2018 | |
| KR | 102097160 | B1 | 4/2020 | |

* cited by examiner

PARASOL PROVIDED WITH CHAIR

TECHNICAL FIELD

The present disclosure relates to a parasol a chair, and more particularly, to a parasol with a chair which allow users such as the elderly sit and rest on a chair by installing the chair on a prop of a parasol installed in a crosswalk, a park, etc., is made lighter and has construction convenience by extruding the chair into a fiber-bonded form, has a high tensile strength to make discoloration inhibition caused by ultraviolet rays excellent while being easily damaged, has non-toxic flame retardant properties to implement high resistance to fire, and has excellent tensile strength, improved strength, and excellent water pressure resistance by using glass fiber, thereby achieving long lifespan.

BACKGROUND ART

Parasols are installed for the purpose of avoiding direct sunlight when carrying out various events and work outdoors. Recently, parasols are sometimes installed by public institutions to avoid sunshine when waiting for a crosswalk or to take a rest in a park.

The present disclosure applies to large parasols installed in crosswalks, parks, or the like, such as the latter.

A type of the large parasol may include a type in which, as disclosed in Korean Patent No. 10-1930783, Korean Patent No. 10-1796394, and the like, a support bar is formed to be inclined on a prop fixed to the ground and at an upper end of the prop, and a folding awning is installed on the support bar, and a type in which, as disclosed in Korean Patent Laid-Open Publication No. 10-2005-0039173, a folding awning is installed on a prop fixed to the ground.

There is an advantage in which such a large parasol may be installed at crosswalks, parks, and the like to block light or take a rest, but since there is no separate chair for sitting and resting, there is a problem in that users need to rest while standing or separate chairs need to be installed.

DISCLOSURE

Technical Problem

The present disclosure has been devised to solve the above problem, and an object of the present disclosure provides a parasol with a chair that improves the convenience of use by installing a chair on a prop of a parasol installed in a crosswalk, a park, etc., so that users such as the elderly may sit and rest on the chair.

Another object of the present disclosure provides a parasol which is manufactured by extruding a chair installed on a prop into a fiber-bonded form to become lighter and improve construction convenience, has a high tensile strength to make discoloration inhibition caused by ultraviolet rays excellent while being easily damaged, has non-toxic flame retardant properties to implement high resistance to fire, and has excellent tensile strength, improved strength, and excellent water pressure resistance by using glass fiber, thereby achieving long lifespan Still another object of the present disclosure provides a parasol with a chair that provides sounds for various purposes to users when the users approach the prop of the parasol by installing a motion sensor on the prop of the parasol.

Technical Solution

There is provided a parasol with a chair provided on a prop, in which the chair includes: a first binding member having first binding flanges formed on both sides and having a center formed as a first arc-shaped plate surrounding the prop; a second binding member that is formed on both sides of the second binding flange to be bound to the first binding flange, and has the center closely attached to the prop and is formed as a second arc-shaped plate surrounding the prop in cooperation with the first arc-shaped plate; a first support member that includes a 1-1th support bar extending outwardly from the center of the upper end of the first arc-shaped plate of the first binding member, a pair of 1-2th support bars extending outwardly from both ends of the first binding member, and a 1-3th support bar connecting ends of the 1-2th support bar and the 1-1th support bar; a second support member that includes a 2-1th support bar extending outwardly from the center of the upper end of the second arc-shaped plate of the second binding member, a pair of 2-2th support bars extending outwardly from both ends of the second binding member, and a 2-3th support bar connecting the ends of the 2-2th support bar and the 2-1th support bar; a first reinforcing member that includes one end fixed to the 1-1th support bar and the other end fixed to the first arc-shaped plate, and a pair of second reinforcing bars having one end fixed to the 1-2th support bar and the other end fixed to the first binding flange; a second reinforcing member that includes one end fixed to the 2-1th support bar and the other end fixed to the second arc-shaped plate, and a pair of second reinforcing bars having one end fixed to the 2-2th support bar and the other end fixed to the first binding flange; and a top plate that is seated and fixed to the first support member and the second support member to allow a user to sit.

Advantageous Effects

According to the parasol with a chair according to the present disclosure, by installing a chair on a prop of a parasol installed in a crosswalk, a park, or the like, it is possible to improve the convenience of use so that users such as the elderly may sit and rest on the chair.

In addition, by manufacturing a chair by extruding a top plate of the chair installed on a prop in a fiber-bonded form, it is possible to achieve long lifespan by making tensile strength, strength improvement, and water pressure resistance excellent.

Furthermore, it is possible to provide sounds for various purposes to users when the users approach the prop of the parasol by installing a motion sensor on the parasol prop.

MODE FOR DISCLOSURE

Hereinafter, a parasol with a chair according to the present disclosure will be described in detail with reference to the accompanying drawings.

Figure 1:
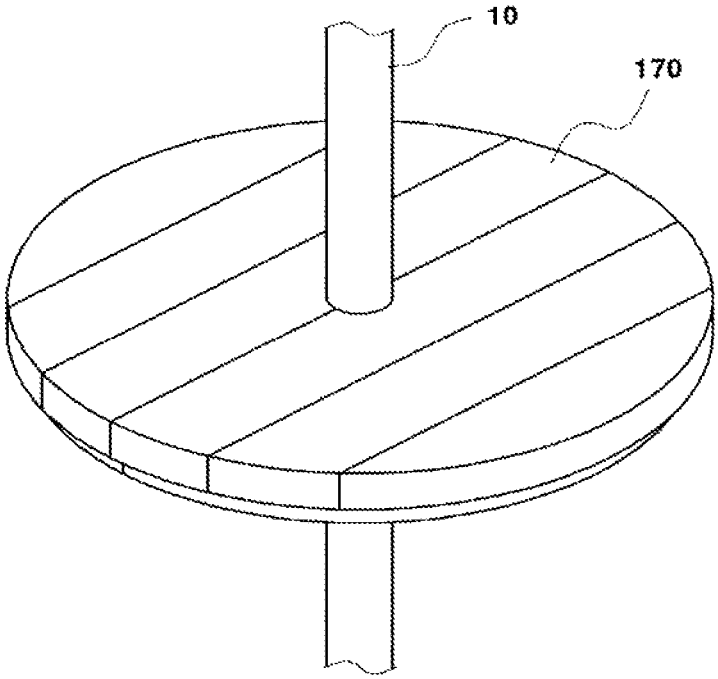
FIG. 1 is an external perspective view of a parasol with a chair according to the present disclosure.
Figure 2:
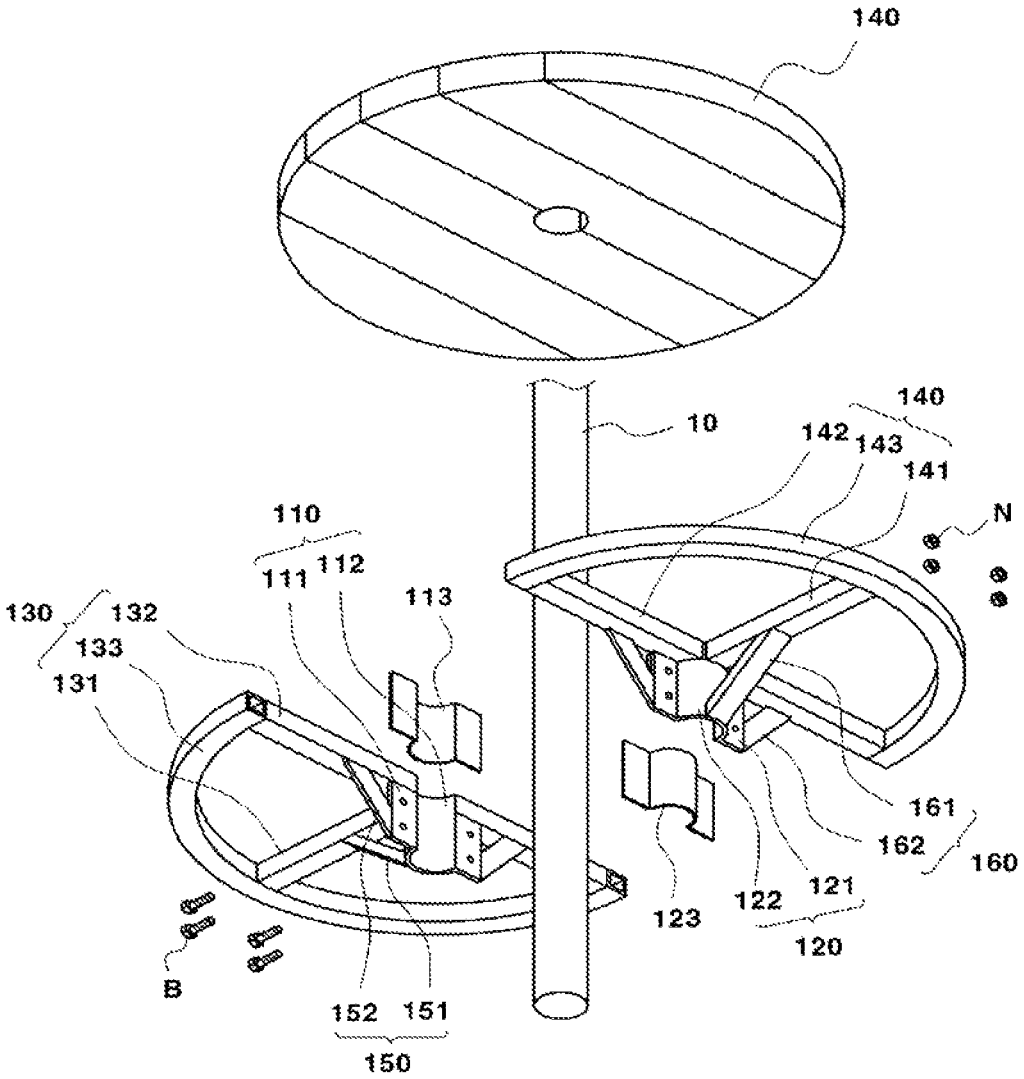
FIG. 2 is a partially separated perspective view of the parasol with a chair according to the present disclosure.
Figure 3:
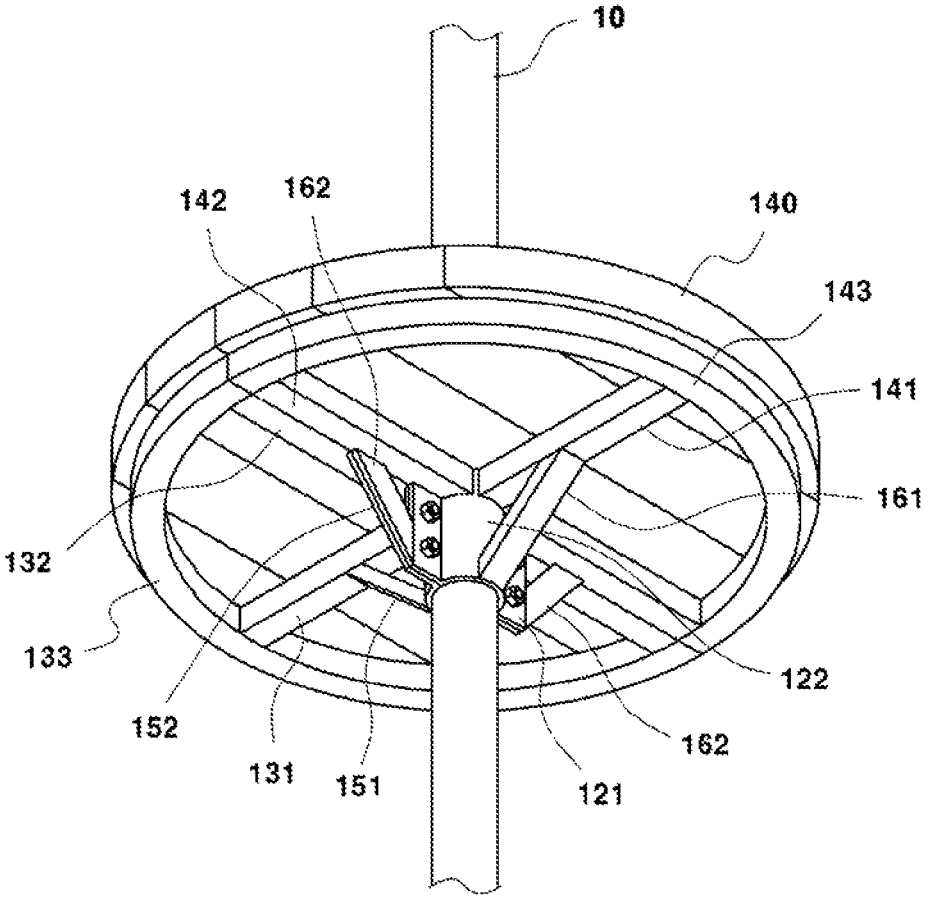
FIG. 3 is a combined perspective view of FIG. 2.

FIG. 1 is an external perspective view of a parasol with a chair according to the present disclosure, FIG. 2 is a partially separated perspective view of a parasol with a chair according to the present disclosure, and FIG. 3 is a combined perspective view of FIG. 2.

The present disclosure is to provide a chair on which a user may sit on a prop of a large parasol installed in a crosswalk or a park, and includes a first binding member 110, a second binding member 120, a first support member 130, a second support member 140, a first reinforcing member 150, a second reinforcing member 160, and a top plate 170.

The first binding member 110 is configured to have first binding flanges 111 formed on both sides thereof and a center formed in a first arc-shaped plate 112 surrounding the parasol.

The second binding member 120 has a second binding flange 121 binding to the first binding flange 111 provided on both sides thereof, and has a center provided with the second arc-shaped plate 122 that is closely attached to the prop to surround the prop in cooperation with the first arc-shaped plate 112.

That is, the first arc-shaped plate 112 of the first binding member 110 and the second arc-shaped plate 122 of the second binding member 120 are configured to surround the prop by half, and the first binding flange 112 and the second binding flange 122 are bound to each other through a bolt B and a nut N, so the first binding member 110 and the second binding member 120 are connected to the prop 10.

Further, contact pads 113 and 123 are inserted into the first binding member 110 and the second binding member 120. Accordingly, when the first binding member 110 and the second binding member 120 are bound to the prop 10, the contact pads 113 and 123 are compressed to the prop 10 while being bound to the prop 10, so it is preferable that a slip does not occur on the prop and is tightly bound.

The first support member 130 includes a 1-1th support bar 131 extending outwardly from the center upper of the first arc-shaped plate 112 of the first binding member 110, a pair of 1-2th support bars 132 extending outwardly from both ends of the first binding member 110, and a 1-3th support bar 133 that connects between ends of the 1-2 support bars 132 and 1-1 support bars 131.

That is, the 1-1th support bar 131, the 1-2th support bar 132, and the 1-3th support bar 133 are members for supporting the top plate to be described later, and the 1-1th support bar 131 and the 1-2th support bar 132 extend outwardly from the center and the edge of the first binding member 100, respectively, and the 1-3th support bar 133 connects and fixes the ends of the 1-1th support bar 131 and the 1-2th support bar 132, which extend outwardly, to each other.

The second support member 140 is formed in the same manner as the first support member 130. That is, the second support member 122 includes a 2-1th support bar 141 extending outwardly from the center upper of the second arc-shaped plate 122 of the second binding member 120, a pair of 2-2th support bars 142 that extends outwardly from both ends of the second binding member 110, and a 2-3th support bar 143 that connects between ends of the 2-2 support bars 141 and the 2-1th support bars 131.

The first reinforcing member 150 is a member for reinforcing the first support member to firmly support the top plate 170, and includes a first reinforcing bar 151 that has one end fixed to the 1-1th support bar 131 and the other end fixed to the first reinforcing bar 151 for reinforcing the 1-1th support bar 131 and a pair of second reinforcing bars 152 that has one end fixed to the 1-2th support bar 132 and the other end fixed to the first binding flange 111 for reinforcing the 1-2th support bar 132.

The second reinforcing member 160 is a member for reinforcing the second support member to firmly support the top plate 170, and includes a second reinforcing bar 161 that has one end fixed to the 2-1th support bar 141 and the other end fixed to the second arc-shaped plate 122 for reinforcing the 2-1th support bar 141 and a pair of second reinforcing bars 160 that has one end fixed to the 2-2th support bar 142 and the other end fixed to the second binding flange 121 for reinforcing the 2-2th support bar 142.

The top plate 170 is a plate that is seated and fixed to the first support member 130 and the second support member 140 so that a user may be seated, and is manufactured in plural to a length suitable for the sizes of the first support member 130 and the second support member 140, and thus, fixed to the first support member and the second support member through a bolt and a nut. Here, the plate disposed in the center of the top plate is formed to be depressed in the center so that the prop may pass.

Figure 4:
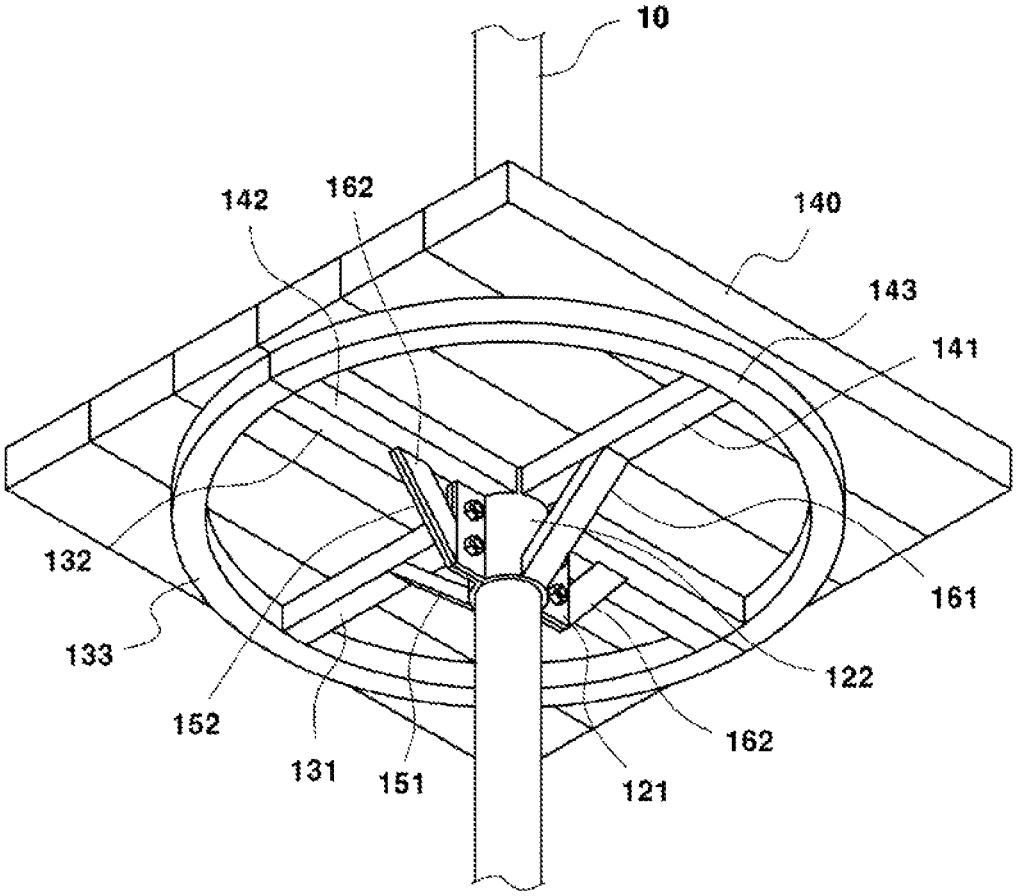
FIGS. 4 to 6 are combined perspective views illustrating another example of the parasol with a chair according to the present disclosure.

Furthermore, the top plate 170 may be formed in a circular shape, but may be formed in a rectangular shape or various shapes not shown as illustrated in FIG. 4.

In the parasol with a chair according to the present disclosure configured in this way, the chair is installed on the prop of the parasol, and thus, the elderly and other users can sit in a chair and avoid the sun while waiting for a bus or a crosswalk, or relaxing in a park, thereby improving the convenience of use.

Figure 5:
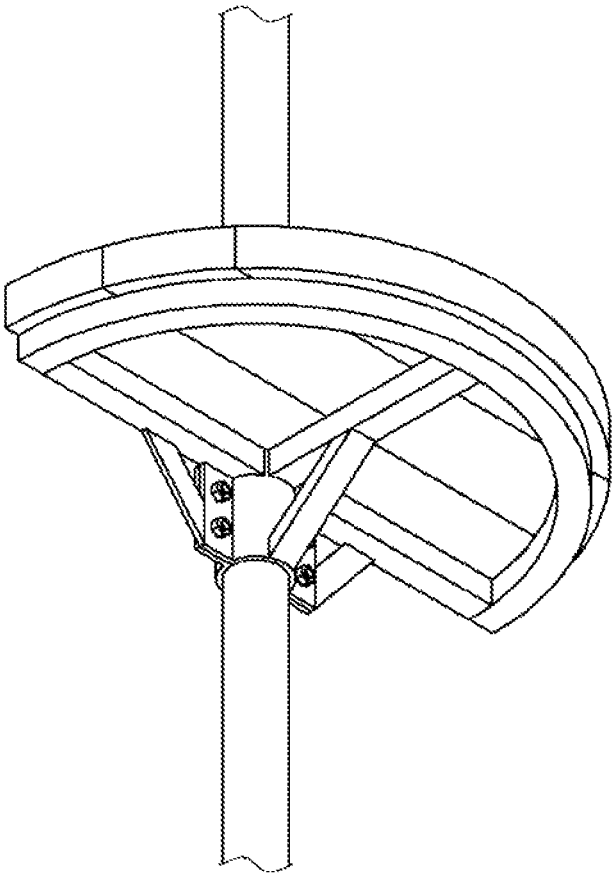
Figure 6:
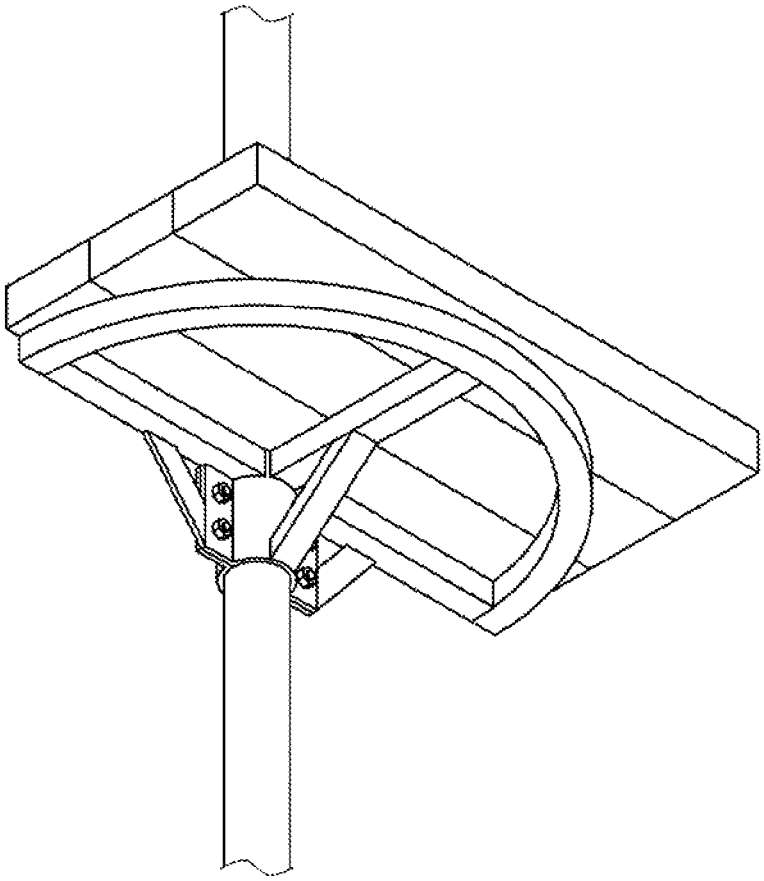

Meanwhile, it is natural that the parasol with a chair according to the present disclosure may form a chair seat in half as illustrated in FIGS. 5 and 6.

Furthermore, the present disclosure provides sounds for various purposes to a user when the user approaches the prop of the parasol by installing a motion sensor not illustrated in the prop of the parasol.

In other words, when the user enters the parasol, the motion sensor detects the entrance signal and provides sound to inform whether the user may cross the crosswalk, provide information to the visually impaired, or promote the local government's business. When the motion sensor is installed in a park, natural sounds such as cicadas and water may be provided to a user so that the user may take a more comfortable rest.

Meanwhile, the top plate to be installed according to the present disclosure may be formed of wood, but is preferable to manufacture by extrusion molding in a fiber-bonded form.

More specifically, the top plate 170 according to the present disclosure is manufactured by including a raw material composition step of composing a basic raw material, a flame retardant composition step of composing a non-toxic flame retardant, a pellet forming step of injecting a flame retardant into an inner diameter of a double die having an inner diameter of 2 cm and an outer diameter of 4 cm, and injecting the basic raw material into an outer diameter to pelletize while extruding, and a pellet forming step of injecting and pelletizing while extruding, and a top plate forming step of putting the extruded pellet and silica gel into an extruder and extruding the extruded pellet and silica to form a top plate.

In this case, the raw material composition step is a step of composing a basic raw material, and the basic raw material includes 3.5 wt % of glass fiber in the form of long fiber having a length of 3 to 5 cm, 5 wt % of antimony doped tin oxide (ATO), 10 wt % of hydrocolloid, 2.5 wt % of apatite powder, 2.5 wt % of dichlorodimethylsilane, 4.5 wt % of nonylphenol ethoxylate, 5% by weight of 2-phenylimidazole, and the remaining high-density polyethylene.

The glass fiber is added to increase the tensile strength and strength while reducing the dimensional change during extruding to accurately maintain numerical stabilization, and also enhance crack resistance and crack suppression properties.

In this case, the ATO contributes to securing insulation and heat shielding performance, and the hydrocolloid forms a gel and maintains a wet state, and thus, added to enhance the adhesion by confirming the adhesiveness for a long time, and in particular, added to prevent wettability by enhancing not only flexibility but also waterproof and water-repellent functions.

In addition, apatite, as a mineral belonging to a hexagonal system, has a complex structure to enhance water pressure resistance.

In addition, dichlorodimethylsilane is a material showing very strong hydrophobicity due to the presence of two chlorine atoms having the second largest electronegativity after fluorine (F), and makes waterproofness and water repellency excellent, contributing to enhance of the water pressure resistance.

In addition, nonylphenol ethoxylate is added to provide a surface active function while increasing occlusion with the resin, and in particular, to obtain an antioxidant effect.

In addition, 2-phenylimidazole reduces heat shrinkage during drying to enhance heat stability, discoloration resistance, and resin deterioration inhibition.

In addition, the HDPE is a high-density polyethylene resin made by polymerizing ethylene, and is one of the plastic resins used in general in daily life.

This HDPE is used as a base resin in the present disclosure because it has excellent weather resistance to withstand various climates, environmental stress cracking resistance, water pressure resistance, and processability.

In this way, when the raw material composition is completed, the non-toxic flame retardant composition step is performed.

The non-toxic flame retardant composition step is a step of preparing a flame retardant by mixing 10 wt % of antimony trioxide, 10 wt % of pentaerythritol, 15 wt % of aluminum hydroxide, 5 wt % of zirconium having a particle size of 0.1 to 0.2 μm, and the remaining polypropylene resin in order to increase the flame retardant.

In this case, the melamine cyanurate has good resin dispersibility, improves flame retardancy without reducing physical properties of a target resin, and has excellent moldability. In particular, it has good occlusal properties with polyethylene resin, so it has the advantage of being able to impart flame retardant properties without using a large amount.

In addition, pentaerythritol is a material having intermediate characteristics between synthetic rubber and plastic, and is added to increase ignition resistance by inducing flame prevention and increase of the limiting oxygen index during combustion.

And, aluminum hydroxide is added to induce hydrophilization of the polypropylene resin.

In addition, the zirconium is added to enhance flame retardancy by forming a film made of oxide or nitride by combining with oxygen during combustion.

The flame retardant according to the present disclosure does not contain, in particular, halogen, and thus, it is non-toxic, so harmful to the human body is excluded, and the polypropylene resin is intended to improve pellet moldability.

In this way, when the non-toxic flame retardant is formulated, the pellet forming step is performed.

The pellet forming step is a step of injecting a flame retardant into the inner diameter of the double die having an inner diameter of 2 cm and an outer diameter of 4 cm, and injecting a basic raw material into the outer diameter to pelletize while extruding.

Through this, a core-shell structure pellet is made in a form in which the basic raw material surrounds the flame retardant.

Thereafter, a top plate forming step of putting the extruded pellets and silica gel into an extruder and extruding them to form a top plate is performed.

Here, the reason for adding the silica gel is to secure lubricity and extrudability while enhancing water resistance, and the water pressure resistance refers to the degree to which water pressure withstands, for example, water pressure resistance of 1500 mm means to withstand water pressure of 1.5 m depth.

In relation to the water pressure resistance, it is known that a fine rain corresponds to the water pressure resistance of 500 mm, a normal rain is 1,000 mm, and a heavy rain is about 1,500 mm. In the present disclosure, it is implemented to be comparable to 6,000 mm water pressure resistance to increase durability.

In addition to this, in the present disclosure, a UV absorber and a UV shielding agent may be further added to the basic raw material itself when the basic raw material is formulated.

In this case, as the ultraviolet absorber, 15 parts by weight of hydrobenzophenone may be further added based on 100 parts by weight of the basic raw material.

In addition, 10 parts by weight of titanium oxide may be further added to 100 parts by weight of the basic raw material as a UV shielding agent.

In addition, 6.5 parts by weight of sulforaphane ($C_6H_{11}NOS_2$) may be further added to 100 parts by weight of the basic raw material in order to suppress decay and increase resistance to UV light to maintain discoloration, durability, and crack resistance, and 25 parts by weight of polyether-block-amide (PEBAX) may further added in order to secure small change in hardness even at low temperatures, excellent fatigue resistance, and small specific gravity, not only excellent extruding processability, but also low hygroscopicity, bending fatigue resistance, weather resistance, flexibility, creep resistance, and excellent adhesion.

In addition, in the present disclosure, 15 parts by weight of sodium-citrate, 10 parts by weight of 6-bromohexanoic acid, and 6.5 parts by weight of polyamideamine may be further added based on 100 parts by weight of the flame retardant.

In this case, the sodium-citrate (Na-citrate: $Na_3C_6H_5O_7$) is added to form a waterproof complex, and the 6-bromohexanoic acid are added to prevent moisture absorption and penetration of oxygen, prevent cracks and breakage of the coating layer, and to prevent deterioration, and the polyamide-amine is added to maintain heat resistance and cold resistance.

In order to evaluate the flame retardancy of the top plate sample manufactured in this way, as the UL 94 V Test Rating, LOI value measurement was tested according to ASTM D2863-17, it was determined as a V-2 grade and it was confirmed that the flame retardancy was excellent.

There is an advantage in that the top plate is light and thus has the improved construction convenience, is not easily damaged due to its high tensile strength, has excellent resistance to discoloration by UV rays, has high resistance to fire with non-toxic flame retardant properties, and uses glass fiber to improve tensile strength, strength, and water pressure resistance, thereby achieving longer lifespan.

INDUSTRIAL APPLICABILITY

The present disclosure relates to a parasol with a chair that has improved construction convenience, excellent discoloration inhibition, non-toxic flame retardant properties, improved tensile strength, improved strength, and excellent water pressure resistance.

The invention claimed is:

1. A parasol with a chair provided on a prop, wherein the chair includes:

a first binding member that includes a first arc-shaped plate configured to surround the prop and first binding flanges formed on opposite sides of the first arc-shaped plate;

a second binding member that includes a second arc-shaped plate configured to surround the prop in cooperation with the first arc-shaped plate, wherein the second binding member is configured to be bound to the first binding flange, and includes a center configured to be closely attached to the prop;

a first support member that includes a first support bar extending outwardly from the center of an upper end of the first arc-shaped plate of the first binding member, a pair of second support bars extending outwardly from opposite ends of the first arc-shaped plate, and a third support bar connecting one side of the first support bar of the first support member and opposite ends of the second support bar of the first support member;

a second support member that includes a first support bar extending outwardly from the center of the upper end of the second arc-shaped plate of the second binding member, a pair of second support bars extending outwardly from opposite ends of the second arc-shaped plate, and a third support bar connecting one side of the first support bar of the second support member and opposite ends of the second support bar of the second support member;

a first reinforcing member that includes one end fixed to the first support bar of the first support member and another end fixed to the first arc-shaped plate, and a pair of second reinforcing bars having one end fixed to the second support bar of the first support member and another end fixed to the first binding flange;

a second reinforcing member that includes one end fixed to the first support bar of the second support member and another end fixed to the second arc-shaped plate, and a pair of second reinforcing bars having one end fixed to the second support bar of the second support member and another end fixed to the first binding flange; and a top plate that is seated and fixed to the first support member and the second support member to allow a user to sit.

2. The parasol of claim 1, wherein a contact pad is inserted into an inside of the first binding member and the second binding member, and the contact pad is firmly bound to the prop without slipping from the prop when the first binding member and the second binding member are bound to the prop.

3. The parasol of claim 1, wherein the top plate is manufactured by including a raw material composition step of composing a basic raw material, a flame retardant composition step of composing a non-toxic flame retardant, a pellet forming step of injecting a flame retardant into an inner diameter of a double die having an inner diameter of 2 cm and an outer diameter of 4 cm, and injecting the basic raw material into an outer diameter to pelletize while extruding, and a pellet forming step of injecting and pelletizing while extruding, and a top plate forming step of putting the extruded pellet and silica gel into an extruder and extruding the extruded pellet and silica to form a top plate, and the raw material composition step includes 3.5 wt % of glass fiber in the form of long fiber having a length of 3 to 5 cm, 5 wt % of antimony doped tin oxide (ATO), 10 wt % of hydrocolloid, 2.5 wt % of apatite powder, 2.5 wt % of dichlorodimethylsilane, 4.5 wt % of nonylphenol ethoxylate, 5 wt % of 2-phenylimidazole, and the remaining high-density polyethylene.

4. The parasol of claim 3, further comprising:

The non-toxic flame retardant composition step is a step of preparing a flame retardant by mixing 10 wt % of melamine cyanurate, 10 wt % of pentaerythritol, 15 wt % of aluminum hydroxide, 5 wt % of zirconium having a particle size of 0.1 to 0.2 μm, and the remaining polypropylene resin, and based on 100 parts by weight of the flame retardant composition, 15 parts by weight of sodium-citrate, 10 parts by weight of 6-bromohexanoic acid, and 6.5 parts by weight of polyamideamine are further added.

* * * * *